United States Patent [19]

Sanders

[11] Patent Number: 4,794,705

[45] Date of Patent: Jan. 3, 1989

[54] HEEL PROTECTOR FOR MEANS SHOES

[76] Inventor: Clarence C. Sanders, P.O. Box 84127, Los Angeles, Calif. 90073

[21] Appl. No.: 105,821

[22] Filed: Oct. 8, 1987

[51] Int. Cl.[4] ..... A43B 13/22

[52] U.S. Cl. ..... 36/72 B; 36/72 R

[58] Field of Search ..... 36/72 R, 72 B

[56] References Cited

U.S. PATENT DOCUMENTS

| | | | |
|---|---|---|---|
| 1,691,582 | 11/1928 | Nowak | 36/72 B |
| 1,769,758 | 7/1930 | Siese, Jr. | 36/72 B |
| 1,830,912 | 11/1931 | Ramey | 36/72 B |
| 3,063,172 | 11/1962 | Beattie | 36/72 B |
| 3,104,479 | 9/1963 | D'Amico | 36/72 B |
| 3,239,953 | 3/1966 | Norton | 36/72 B |
| 4,441,264 | 4/1984 | Hante-Gubas et al. | 36/72 B |
| 4,660,301 | 4/1987 | Atwood | 36/72 B |
| 4,662,082 | 5/1987 | Shabazz | 36/72 B |

FOREIGN PATENT DOCUMENTS

| | | | |
|---|---|---|---|
| 108079 | 7/1917 | United Kingdom | 36/72 B |
| 2118427 | 11/1983 | United Kingdom | 36/72 B |
| 2171588 | 9/1986 | United Kingdom | 36/72 B |

*Primary Examiner*—Steven N. Meyers

*Attorney, Agent, or Firm*—Albert O. Cota

[57] ABSTRACT

An adjustable men's shoe heel protector which has a body (20) of thermoplastic material in the shape of the heel portion of a shoe. The body (20) is configured to fit all sizes of shoes covering only the rear portion of the shoe counter. Attachment is primarily accomplished by utilization of a penetrating lip (22) that fits between the hose heel and the counter and a sliding hook tab (30) or (32) that is secured over the top of the counter. The combination of the lip and tab securely holds the protector in place while the user is driving a motor vehicle, thereby preventing scuffing of the shoe. In addition to the lip (22) and tab (30), (32), an upper strap (24) circling over the wearer's foot or a lower strap (30) under the instep may also be used. Both straps are removably connected to the protector using hook and loop tape (26). The adjustment in size and convenience of attachment overcomes the problem heretofore encountered with heel protectors.

1 Claim, 2 Drawing Sheets

HEEL PROTECTOR FOR MEANS SHOES

TECHNICAL FIELD

The present invention relates to covers for shoes in general. More specifically to a protector for a mans shoe that is worn over the heel counter when driving a motor vehicle.

BACKGROUND ART

The problem of shoes being worn or scuffed by the floorboard of a motor vehicle has been encountered since the introduction of the modern automobile. Attempts to solve this problem date as far back as the mid 1920's when automobiles began to be popular, however,the prior art presented at that time and since has not yet been publicly accepted to any great extent. The basic difficulty encountered by the driver stems from dirt and grit being carried into the vehicle on the bottom of the shoes and in time the materail collects in the carpet, or pad, creating an extremely abrasive surface upon which the drivers foot must rest. Since the driver has no alternative but to maintain the foot position on alternately the accelerator or brake the movement, as well as the vibration of the vehicle forces the rear portion of the heel to abraid and wear. This is particularly true in leather soes having a light colored base coating, such as a mans dress shoe. Prior art has attempted to solve this problem by utilizing a cover over the heel portion which does, indeed, protect the surface, but the approach requires special sizes and individual adjustment with straps or clips to hold the device in place. While this direction accomplishes the end result, no provisions have been made for any adjsutment in size of the shoe or height of the counter.

A search of the prior art did not disclose any patents that read directly on the claims of th instant invention, however, the following U. S. Patents were considered related:

| U.S. Pat. No. | Inventor | Issue Date |
|---|---|---|
| DES 287,660 | Strickland | Jan. 13, 1987 |
| 4,459,764 | Beck | Jul. 17, 1984 |
| 3,861,399 | Huff | Jan. 21, 1975 |
| 3,851,412 | Voegele et al | Dec. 3, 1974 |
| 3,095,659 | McClellan | Jul. 2, 1963 |

Strickland teaches a single strap heel protector taht fits over the entire boot heel with the bottom portion partially covering the surface of the heel. A separate strap is attached to the protector through a pair of slots, one on each side.

Beck, on the other hand, discloses a guard that is in a generally U-shaped configuration and is sized to provide an interference fit on the back of the shoe. Again, the bottom portion of the heel is covered by the guard.

Huff combines a heel protector and arch support inside the shoe and is included for background purposes indicative of the art to which the invention relates.

Voegele et al utilizes a flexible shell conforming to the shape of the heel with a spring steel band affixed to the interior contour of the shell parallel. to he bottom. The gripping action of the band holds the protector onto the heel of the shoe and a lip over the ront of the heel provides containment of the device in use.

McClellan uses soft leather with a rounded upper edge and a steel U-shaped clamp spring. A steel wire is encapsulated in the upper and lower edges maintaining the desired shape. The clamp grasps the heel and the wire holds the shape of the device, allowing use without distracting from the looks of the shoe.

It is apparent from the prior art thus recognized that each device is made to fit a particular size shoe with the recognization of the problem of different sizes of shoes still unanswered. Still further, steel clamps provide the attaching means or combination straps with positive attachment also lacing.

DISCLOSURE OF THE INVENTION

It is, therefore, a primary object of the invention to provide a single heel protector that will fit all types and styles of men's shoes having low heels, without respect for form or size. That is achieved by the use of a novel wrapper type body that is held in place primarily by a penetrating shelf that fits between the heel and the shoe counter and a tab located on the upper edge of the protector that bends over the top of the shoe. This combination provides a rigid secure attachment while allowing a universal fit.

The tab may be designed in either of two configurations. In the preferred embodiment, the tab is comprised of an annealed tab that is affixed permanently to the upper portion of the body. To use this tab, it is simply bend over the counter of the shoe. In the second configuration the tab consists of a sliding hook tab with a rigid hook member that is in an inverted J-shape. The tab slides along a resilient slide track that is pemanently affixed to the body.

In addition to the above combination, a strap that can be disposed either above the body, over the wearer's foot, or below the body, under the wearer's instep, may also be employed to further add security to the shoe protector.

An important object of the invention lies in the security of the attachment of the shoe protector. The combination of the penetrating shelf and tab holds ht eprotector in place firmly, and limits the vertical movement, making hte heel rotector fit the shoe snugly and eliminate the rubbing of the protector against the shoe causing damage. Some prior art, in the attempt to create universatility uses different combinations, but the instant invention eliminates this problem completely.

Still another object of the invention provides a disposable feature for the protector, in that the major portion of the invention is fabricated of a cost-effective thermoplastic material. This object allows the protector to be used on one or more shoes and then discarded, as the cost is such that prolonged use until it is worn out is unnecessary. Further, different colored shoes requiring different protectors may be maintained at a cost that is not prohibitive.

Yet another object of the invention is the simplicity of adjustment and use. The shape and attaching elements are easy to understand and the entire protector is obvious in its function and method of attachment.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
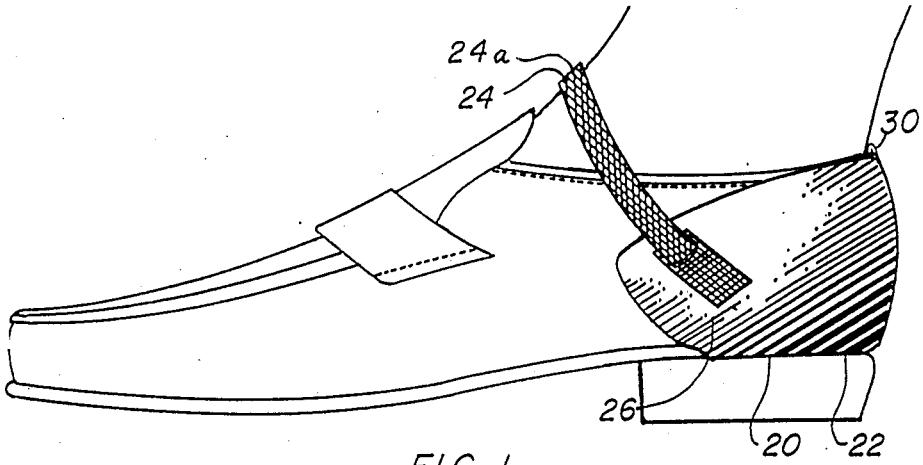
FIG. 1 is a left side elevation view of the preferred embodiment attached to a man's shoe with the strap disposed above the wearer's foot.

The best mode for carrying out theinvention is presented in terms of a preferred embodiment having two configuration of a tab 30 or 32 that secures the protector to the shoe counter. The embodiment having the preferred tab, as shown in FIGS. 1–8, is comprised of a body 20 that basically conforms to the rear heel area of man's shoe. The body 20 is arcuate at the top and convex in shape and is juxtaposed over the shoe counter. This shape is based on an overall height of a small sized shoe with sufficient mass to cover the important area of the heel in any size shoe, even up to the largest practical size. The body 20 has a front and rear portion, along with a top and bottom, and is composed of a relatiely resilient material, such as thermoplastic. This may be any suitable substance, such as styrene, polyproplene, polyethylenes, or cellulose acetate butyrate, and the like. It will be noted that the invention is not limited to the materials suggested above, but amy include other thermoplastic substances, as well as leather, laminated fabric, metal, etc. This configuration, as can be seen in the drawings, covers the counter area of the shoe and leaves the heel open, providing a protective cover for the shoe in the region that rests on the floorboard of a motor vehicle, when in the driving position and does not affect normal walking.

Figure 6:
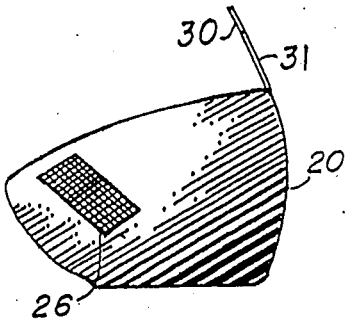
FIG. 6 is a side elevational view of the heel protector removed from the shoe with the attaching tab unbent.
Figure 7:
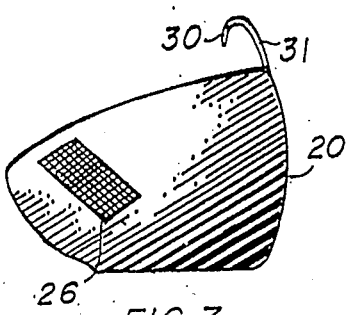
FIG. 7 is a side elevational view of the heel protector removed from the shoe with the attaching tab bent in the attachment position.
Figure 8:
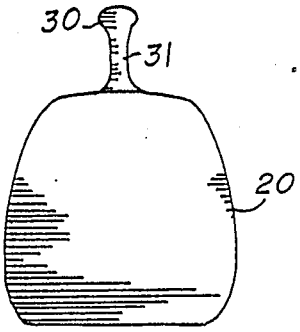
FIG. 8 is a rear elevational view of the heel protector showing the back view of the tab in the unbent position.

A penetrating lip 22 is molded integrally with the body on the bottom and is formed inwardly to rest within the space between the heel and the counter of the shoe. This lip 22 establishes the location of the protector with respect to the heel and, therefore, any size counter may be accommodated with equal ease. The preferred tab 30, as shown in FIGS. 6-8 is made of an annealed metal that is permanently affixed to the upper portion of the body 20. The tab 30 is attached permanently by molding integrally with the body 20 or installed by fastening means well known in theart, such as rivets, staples, grommets, and the like. The tab 30 is formed in a narrow, relatively thin shape with an enlarged end on the extending segment. This configuration is best illutrated straight in FIGS. 6 and 8 and bent over in FIG. 7. When the protector is installed on the shoe, the tab 30 is folded downward forming a hook over the counter holding the protector in place in a clamplike fashion. As the tab 30 is annealed, themetal is softened and will not break with constant usage of folding and unfolding into the hook shape. In order to protect the users socks from possible sharp edges on the tab, a coating 31 of resilient thermoplastic material completely covers the exposed surface. This coating may be added after the tab 30 is attached to the body 20, or may be formed integrally with the body during the initial manufacturing process. The coating does not interfere with the function of the tab 30 and adds some possible aesthetic as well as functional value to the invention.

Figure 9:
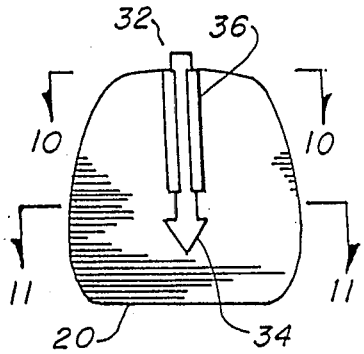
FIG. 9 is a rear view of the heel protector removed from the shoe illustrating the sliding hook tab that attaches the rear portion to the counter of the shoe.
Figure 10:
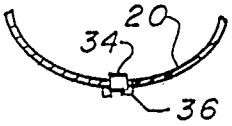
FIG. 10 is a cross-sectional view taken along lines 10—10 of FIG. 9.
Figure 11:
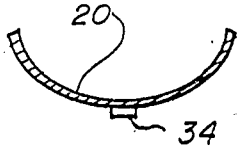
FIG. 11 is a cross-sectional view taken along lies 11—11 of FIG. 9.

The second configuration of the tab consists of a sliding hook tab 32 that is added to the top rear portion of the body 20. This tab is shown in FIGS. 9 through 11 and consists of a rigid hook member 34 and a resilient slide track 36. The track 36 is formed integral with or permanently afixed to the body 20 and is in a "C" or channel shape running perhaps half of the height of the body 20. The rigid hook member 34 is in an inverted "J" shape with an elongate opposed end for gripping, and is positioned within the track 36, which by its nature, is sized slightly smaller than the hook member 34, allowing the member to slide up and down when manually pushed or pulled, but ha sufficient interference to retain its position when released. This allows the hook portion of the member 34 to be placed over the counter of the shoe and pulled taut, creating an adjustable closure attachig the protector to any size shoe, regardless of the size or height of the counter.

Figure 2:
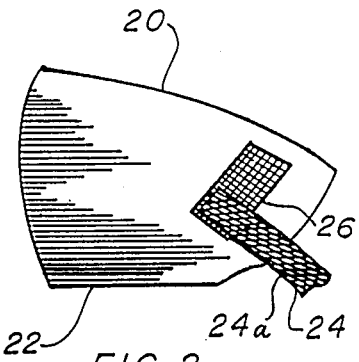
FIG. 2 is a right side elevational view of the heel protector removed from the shoe with a cut-away view of the attaching strap disposed below the instep of the shoe.
Figure 3:
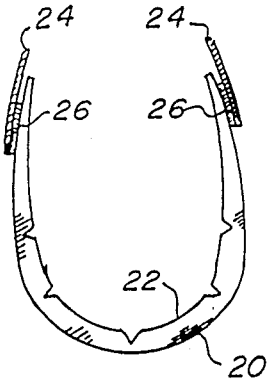
FIG. 3 is a bottom view of the heel protector removed from the shoe with the attaching straps partially cut-away.
Figure 4:
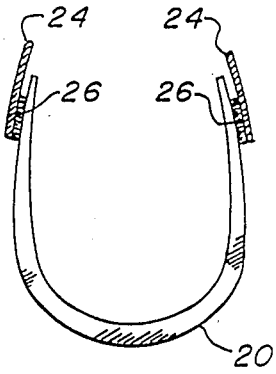
FIG. 4 is a top elevational view of the heel protector removed from the shoe with the attaching straps partially cut-away for clarity.
Figure 5:
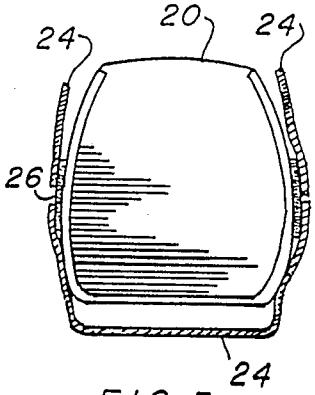
FIG. 5 is a front elevational view of the invention removed from the shoe showing the strap in both the top and bottom position.

In addition to the combination of the lip 22 and the tab 30, 32 the heel protector may also utilize a strap 24 to help secure the body to the shoe. The strap, as shown in FIG. 1, may be disposed above the body 20, over the wearer's foot, such that the body resists movement in a downward and rearard direction, or the strap 24 may be disposed below the body 20, as shown in FIG. 2, under the wearer's instep, such that the body resists upward and rearward movement. The strap 24 is comprised of a length of either woven webbing, such as nylon, dacron, cotton, or some other fabric, and is resilient to the extent that it bends easily over one's foot, but has little stretch to its length. The strap 24 may be alternately fabricated of an elastic material **24*a* with equal ease. The strap 24*a*** has sufficient structural integrity to maintain conformance of the protector to the shoe while allowing elasticity thereof.

In any event, the strap 24 is attached to the body 20 using a set of hook and loop tape 26, commonly known by its registered trademark VELCRO, either the hook or loop side may be attached to the strap 24. The mating side is attached to the body 20 at the appropriate location near the front, as illustrated in FIGS. 1 and 2. The attachment of the hook and loop tape 26 to the strap 24 and body 20 is by means well known in the art, such as sewing, heat bonding, gluding with adhesive, and the like.

The portion of the hook and loop section 26, attached to the heel protector 20, that is not used after the strap 24 is affixed, may be used as a finger grip. The finger grip allows the user to hold the body 20 in place while the strap 24 is being lifted or pulled under, as the case may be.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A heel protector for men's shoes used while driving a motor vehicle comprising:

(a) a body in generally a U-shape having a front and a rear portion, with a top and bottom composed of a relatively resilient material characterized by a shape conforming to a man's shoes in the area of the upper heel and counter, said body juxtapositioned thereupon creating a shield protecting the shoe from wear and scuffing when resting upon a vehicle floorboard;

(b) a penetrating lip integral with said body on the bottom converging inwardly creating a shelf configured in such a manner as to rest within the space between the heel and counter of a man's shoe, such that a gripping surface created holding the protector in place resisting movement in a vertical direction when the protector ismounted on a shoe; and (c) a tab affixed to the upper portion of said body and cofigured in such a manner as to be folded downward to define a hook over the counter of one's shoe when worn, said tab is comprised of a sliding hook tab having a rigid hook member in an inverted J-shape with an elongate opposed end, and a resilient slide track permanently affixed to the body, where hook member is moveably retained within the slide track and the track has sufficient resiliency to hold the hook member in place by friction, creating an adjustable retaining member to assure attachment of the heel protector to the wearer's shoe.

* * * * *